United States Patent [19]

Sakamaki et al.

[11] Patent Number: 4,595,348

[45] Date of Patent: Jun. 17, 1986

[54] APPARATUS FOR SUPPORTING ROTARY SLEEVE OF ROTARY COMPRESSOR BY FLUID

[75] Inventors: Hiroshi Sakamaki, Utsunomiya; Yukio Horikoshi, Kazo; Kikuji Yanagihashi, Yono, all of Japan

[73] Assignee: Nippon Piston Ring Co., Ltd., Tokyo, Japan

[21] Appl. No.: 691,482

[22] PCT Filed: May 19, 1984

[86] PCT No.: PCT/JP84/00254

§ 371 Date: Jan. 11, 1985

§ 102(e) Date: Jan. 11, 1985

[87] PCT Pub. No.: WO84/04783

PCT Pub. Date: Dec. 6, 1984

[30] Foreign Application Priority Data

May 20, 1983 [JP] Japan ..... 58-87733
May 20, 1983 [JP] Japan ..... 58-87734

[51] Int. Cl.[4] ..... F04C 18/348
[52] U.S. Cl. ..... 418/173
[58] Field of Search ..... 418/173

[56] References Cited

U.S. PATENT DOCUMENTS 4,197,061 4/1980 Hill ..... 418/173

*Primary Examiner*—Leonard E. Smith
*Attorney, Agent, or Firm*—Birch, Stewart, Kolasch & Birch

[57] ABSTRACT

An apparatus provided in a rotary compressor comprising an air-bearing room (40) defined between the inner periphery of the center housing (22) and the outer periphery of the rotary sleeve (30) to have an air-bearing effect for floatingly supporting the rotary sleeve rotating with a plurality of vanes. The air-bearing room (40) is supplied with discharge-pressure air from the discharge chamber (43) or the maximum-pressure air from the compression side working space (43). Guide grooves (74) are partly or fully formed in either or both of the inner periphery of the center housing and the outer periphery of the rotary sleeve. Air enters the air-bearing room and flows along the guide grooves to axially equalize the bearing effect.

20 Claims, 18 Drawing Figures

APPARATUS FOR SUPPORTING ROTARY SLEEVE OF ROTARY COMPRESSOR BY FLUID

TECHNICAL FIELDS

The present invention relates to apparatus for fluidly supporting a rotary sleeve rotatably mounted in a compressor housing for rotation with a plurality of vanes which are movably fitted in a rotor rotatable at an eccentric position in the rotary sleeve, more particularly to a rotary sleeve supporting apparatus of the type having a filmy air-bearing room defined between the inner periphery of the center housing of the rotary compressor and the outer periphery of the rotary sleeve.

BACKGROUND ART

The inventors of this application have previously proposed a vane-type rotary compressor provided with a rotary sleeve interposed between a center housing and a rotor, under Japanese Patent Application No. 56-162025 (JP, A, 58-65988). The compressor is particularly suitable for use with an automobile engine required to operate over a wide speed range because of being substantially free from frictional heat as well as wear at the apex of each vane. However, there is the possibility of scuffing and seizure troubles if air is highly compressed in the compression working space within the compressor to push the rotary sleeve from within to the inner periphery of the center housing.

From a study on the movement of the rotary sleeve, it has been clarified that a contact between the rotary sleeve and the center housing possibly takes place at not a specific line but a relatively wide zone. The inventors have proposed under patent application No. 58-28608 (JP, A, 59-155589) that the air inlet is provided at the starting line of the contact zone in which the contact is likely to occur and internally connected to one of the open air, the discharge chamber, and the compression working space under the maximum pressure to increase an amount of air flowing over the contact zone and improve the bearing effect of the air-bearing room. However, there has remained a problem that the bearing effect is not uniformly raised, that is, high in the center but low in the opposite ends, resulting in that the rotary sleeve has the opposite ends unbalanced in the air-bearing room.

It is the primary object of the invention to provide a rotary sleeve supporting apparatus in which the rotary sleeve has the opposite ends thereof well balanced when air is supplied into the air-bearing room to increase an amount of air flowing about the rotary sleeve.

DISCLOSURE OF INVENTION

To attain the object as described above, the invention consists in the apparatus comprising two guide grooves formed peripherally in the opposite end portions of the outer periphery of the rotary sleeve and/or the inner periphery of the center housing. The guide grooves allow air supplied to rapidly spread and go round on the inner periphery of the center housing. In the case that the peripheral grooves are formed in the contact zone of the center housing, air rapidly flows along the contact zone to spread to the opposite ends with the result that the rotary sleeve has the opposite ends thereof supported without contacting the inner periphery of the center housing.

When an abnormal movement of the rotary sleeve is caused by a sudden speed change in the engine driving the rotary compressor, the rotary sleeve sometimes contacts the suction side inner periphery of the center housing. Accordingly, the guide grooves are desirably provided in the suction side inner periphery of the center housing to allow the air passed by the contact zone to go round rapidly toward the suction side in which the bearing effect is increased to prevent the rotary sleeve from contacting the suction side inner periphery of the center housing.

In preference, the full round guide groove is formed in each side end position of the outer periphery of the rotary sleeve and/or the inner periphery of the center housing to produce a stable bearing effect in all the round of the air-bearing room. The full round guide groove can be formed with more ease than the partial one. The guide groove is preferably connected to the discharge chamber or working space under the maximum pressure and supplied with high-pressure air to increase the bearing effect of the air-bearing room.

BEST MODE FOR CARRYING OUT THE INVENTION

Figure 1:
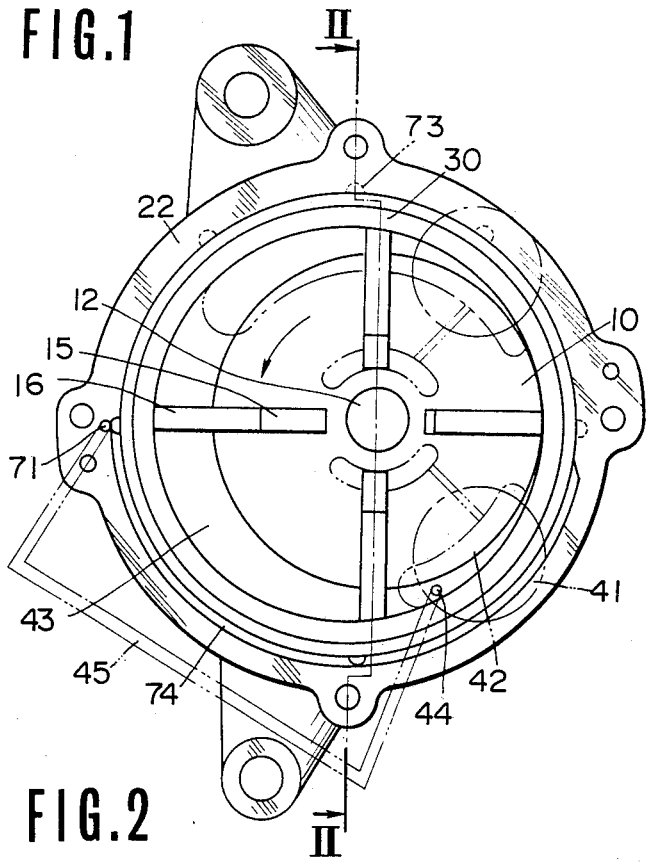
FIG. 1 is a side elevation of the rotary compressor according to the invention, the rear side housing being eliminated for illustration of the side surface of the rotor.

The invention will be explained with reference to drawings which illustrate specific embodiments. Referring initially to FIG. 1, the compressor has a rotor 10 eccentrically disposed in the rotary sleeve 30. The rotor 10 rotates in the direction as indicated by an arrow and has a plurality of vanes 16 movably fitted in the respective vane grooves 15. The vane 16 has its apex in contact with the inner periphery of the rotary sleeve 30. The rotary sleeve 30 is floatingly supported in the air-bearing room 40 confined between the inner periphery of the center housing 22 and the outer periphery of the rotary sleeve 30. The radial width of the air-bearing room 40 is exaggeratedly shown but really very thin, being less than 0.1 mm.

The working space 43 is defined by the two adjacent vanes 16 to turn round within the rotary sleeve. The pressure in the working space 43 is low in the suction side and high in the compression side, being maximum when the working space is just before a position in which it is connected to the discharge chamber 41 through the discharge port 42. An inlet port 71 is disposed in the compression side inner periphery of the center housing 22 and axially alined with the starting line of a zone which the rotary sleeve 30 is likely to contact. An extract port 44 is given to the working space 43 under the maximum pressure and internally connected to the inlet port 71 in the compression side inner periphery of the center housing 22 through an inlet passage 45. Although the passage 45 is shown as it were outside the center housing 22, it really passes within the center housing. In the case of the rotary compressor which operates at high speeds, the inlet port may be connected to the atmosphere or open air, because the rotary sleeve has a pumping action. Two guide grooves 74 are provided in the opposite ends of the compression side inner periphery of the center housing 22 to extend peripherally from the starting line of the contact zone to the terminal of the same.

Figure 2:
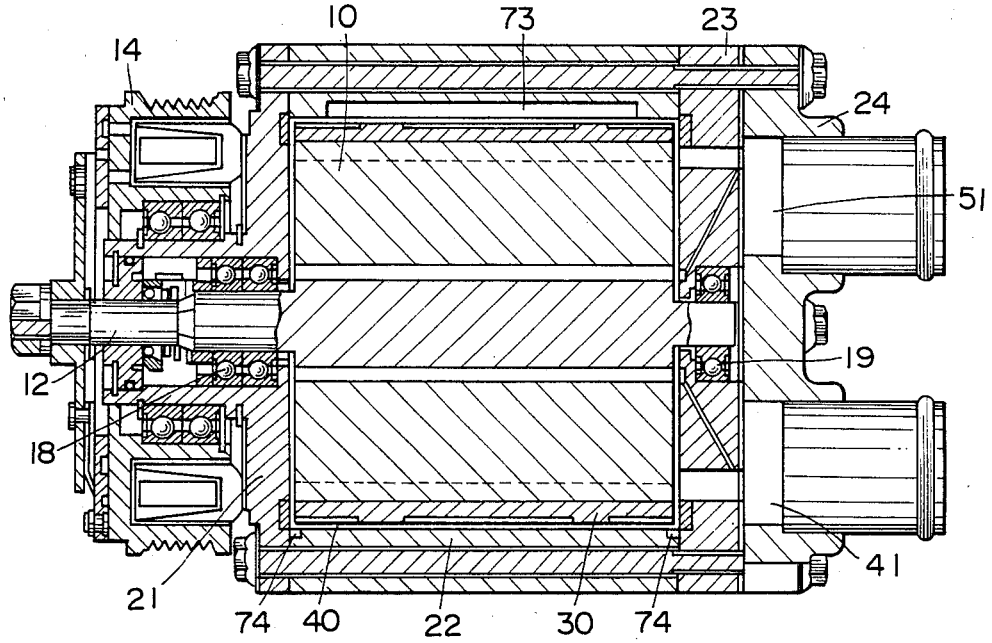
FIG. 2 is a section taken along the line II—II of FIG. 1.
Figure 3:
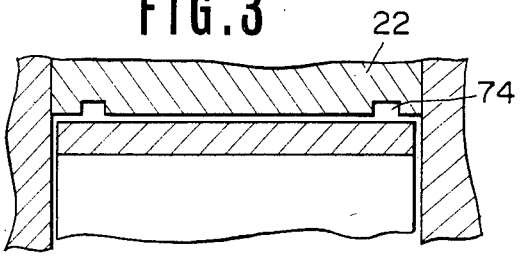
FIG. 3 is an axial section of the relevant part of another embodiment, showing the guide groove.

As seen in FIG. 2, the rotor 10 is integrally shaped with a shaft 12 rotatably supported by bearings 18, 19 in the respective front and rear housings 21, 23 and fixed at the front end thereof to a pulley 14 which is rotated by a non-illustrated engine. A gasket is interposed between the rear housing 23 and the rear cover 24 in which the discharge chamber 41 and the suction chamber 51 are provided. The compression side inner periphery of the center housing 22 has the opposite ends thereof formed with two guide grooves 74 as a part of the air-bearing room 40 defined between the contact zone of the center housing 22 and the outer periphery of the rotary sleeve 30. The guide groove 74 is not limited to the opposite ends of the center housing 22. As seen in FIG. 3, the guide grooves 74 can be formed in a position apart from but in the vicinity of the opposite ends of the center housing. However, in general, the guide groove situates outside air-accumulating grooves described below.

While the compressor rotates, high-pressure air enters through the inlet port 71 at the starting line of the contact zone to rapidly go round along the guide grooves 74 and spread toward the center, thereby the bearing effect in the contact zone of the air-bearing room 40 being axially uniformly raised. Thus, the rotary sleeve 30 is fluidly supported and well balanced without contacting the contact zone even if compressed air pushes the rotary sleeve 30 from within toward the contact zone.

Figure 5:
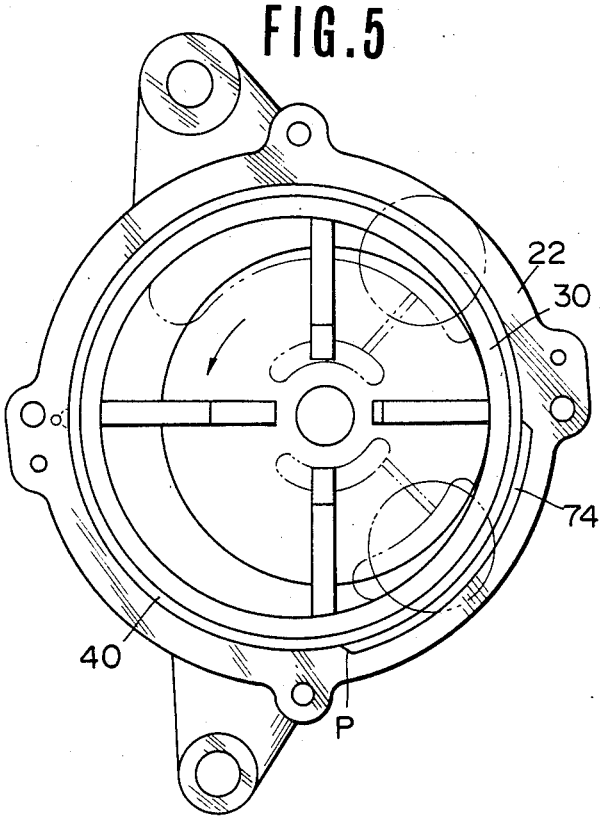
FIGS. 5 to 7 are views, similar to FIG. 1, of different embodiments.

As seen in FIG. 5, the guide groove 74 can be provided between a position P in which the air-bearing room has the maximum pressure and the terminal line of the contact zone, if a sufficient amount of air flowing from the inlet port to the position P needs no effect due to the guide groove thereon. The guide grooves 74 are effective to balance the opposite ends of the rotary sleeve 30 and prevent the rotatary sleeve from contacting the contact zone in the same way as that of FIG. 1.

Figure 6:
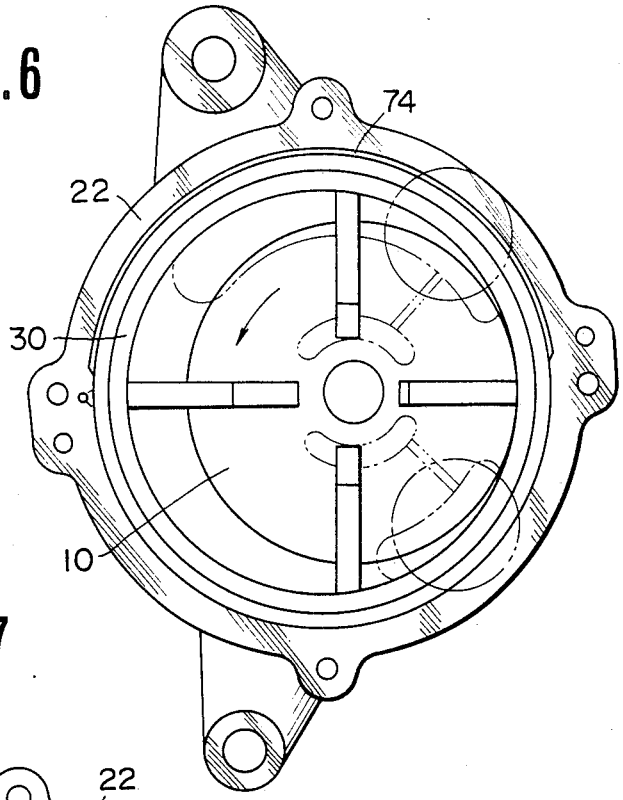

As seen in FIG. 6, the guide grooves 74 are provided in the suction side opposite to the contact zone to allow air passed by the contact zone to rapidly go round toward the suction side in which the air increases the bearing effect in the suction side of the air-bearing room 40. The guide grooves 74 keep the opposite ends of the rotary sleeve 30 evenly balanced and prevent the rotary sleeve from contacting the suction side inner periphery of the center housing 22 even if a sudden change in the rotational speed of engine causes an irregular movement of the rotary sleeve 30.

Figure 7:
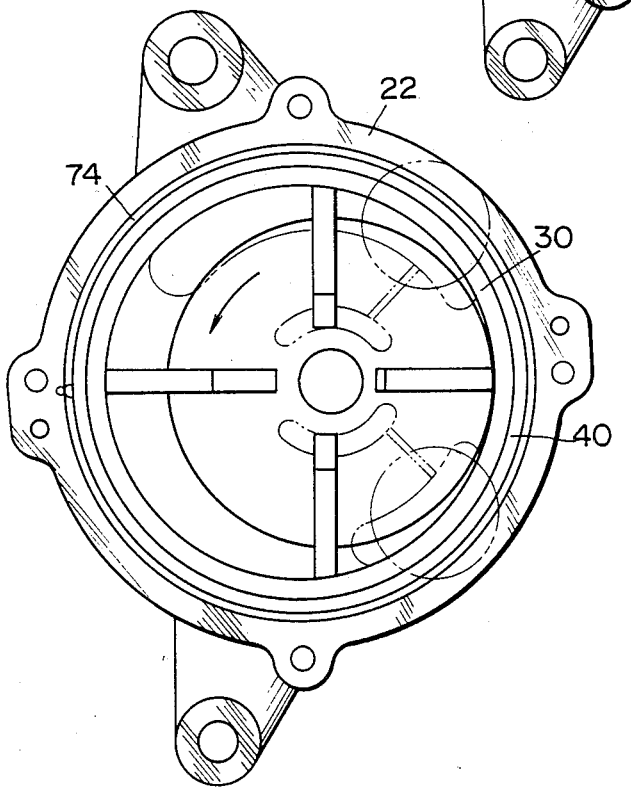
Figure 8:
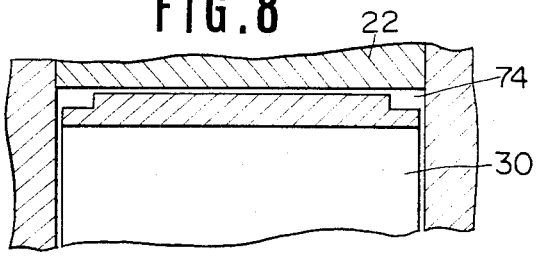
FIGS. 8 and 9 are views, similar to FIG. 3, of different embodiments.
Figure 9:
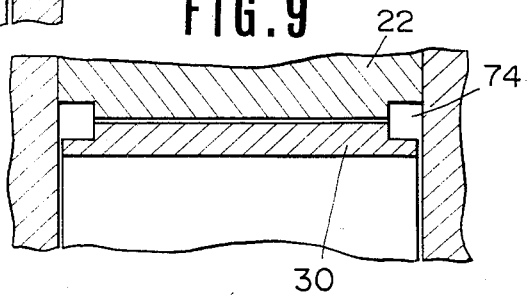
Figure 10:
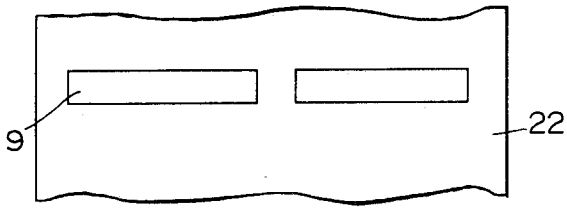
FIGS. 10 to 13 are partial development of the inner periphery of the center housing, showing the air-accumulating groove in different embodiments.
Figure 11:
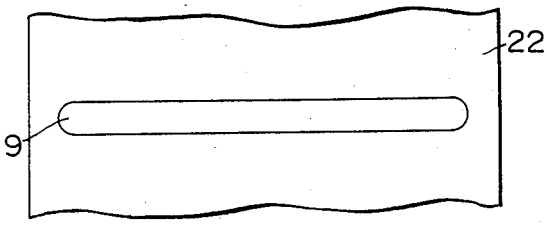
Figure 12:
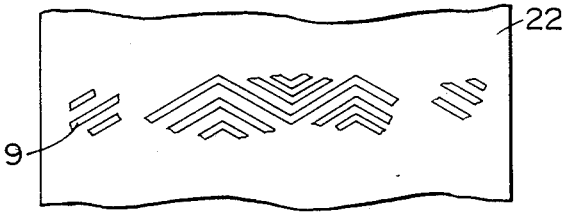
Figure 13:
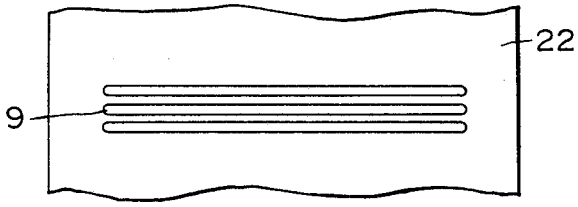

As seen in FIG. 7, the full round guide grooves 74 are formed in the inner periphery of the center housing 22 to increase the bearing effect of the air-bearing room 40 with the result that the rotary sleeve 30 is prevented from contacting not only the compression side inner periphery of the center housing 22 as in the embodiment of FIG. 1 but also the suction side inner periphery as in the embodiment of FIG. 5. The guide groove 74 is not limited to the center housing. The guide grooves 74 can be formed in the opposite ends of the rotary sleeve 30 or in the vicinity thereof as shown in FIG. 8. The guide grooves 74 are also formed in the opposite end portions of the center housing 22 and the rotary sleeve 30 as shown in FIG. 9. The air-accumulating grooves 73 in FIGS. 1 and 2 are also useful to increase the bearing effect of the air-bearing room 40 and shaped in any form of a pair of rectilinear grooves as shown in FIG. 10, a single rectilinear groove as shown in FIG. 11, a group of herringbone grooves as shown in FIG. 12 and a group of narrow linear grooves as shown in FIG. 13. The air-accumulating grooves of herringbone can be formed in one or two parts of the inner periphery, for example, the contact zone and/or the opposite zone thereto of the center housing or in the entire inner periphery of the center housing to increase the bearing effect of the air-bearing room.

Figure 4:
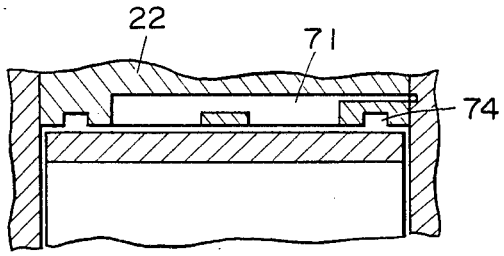
FIG. 4 is an axial section along the inlet port of the embodiment of FIG. 3.
Figure 14:
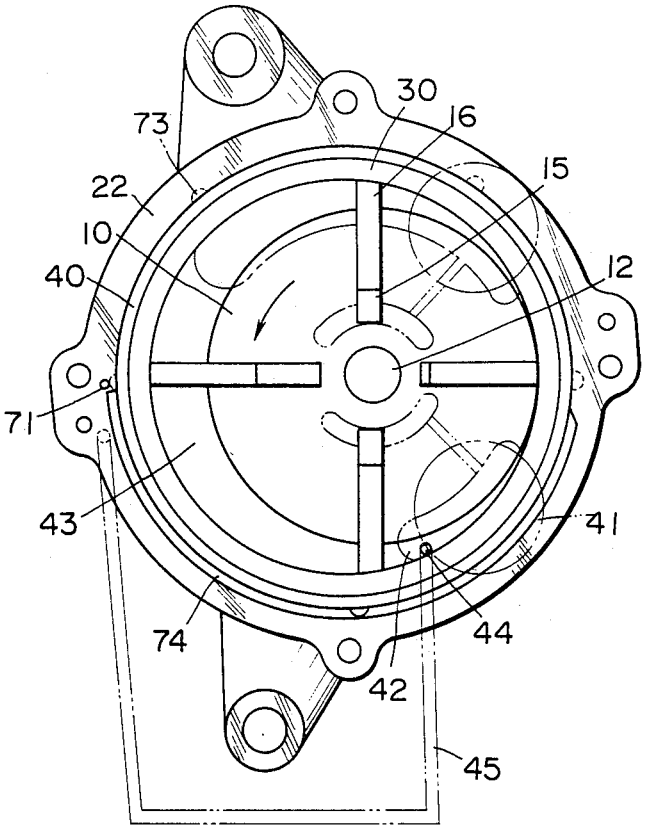
FIG. 14 is a view, similar to FIG. 1, of a different embodiment, showing the guide groove supplied with high-pressure air.

In the embodiments of FIGS. 1 to 8, the inlet port 71 is separated from the guide groove 74 as seen in FIG. 4. But, the inlet port 71 can be formed within the guide groove 74 as seen in FIG. 14. The inlet port 71 is internally connected to the discharge chamber 41 or the extract port 44 in the working space 43 under the maximum pressure through the inlet passage 45. The inlet passage 45 is shown as it were outside the center housing 22 but really is within the center housing 22. The guide grooves 74 of FIG. 14 lie between the starting and terminal lines of the contact zone in the inner periphery of the center housing 22. The inlet passage 45 of FIG. 15 passes through axially the wall of the center housing 22 to the inlet port 71 in the bottom of the guide groove 74. In the case of the guide groove provided only in the rotary sleeve, the inlet port desirably opens to the guide groove.

Figure 16:
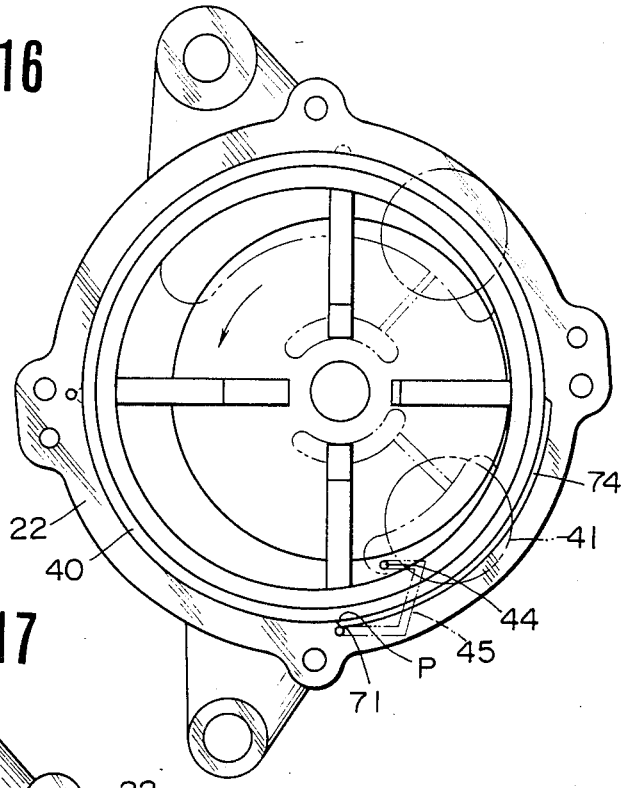
FIGS. 16 to 18 are views, similar to FIG. 14, of different embodiments.

In the embodiment of FIG. 16 in which a sufficient amount of air flows in a part of the contact zone from the inlet port to a position P in which the air-bearing room has the maximum pressure, the guide grooves 74 are formed between the position P and the terminal line of the contact zone in the inner periphery of the center housing 22. The inlet port 71 is provided in the vicinity of the starting line of the contact zone and internally connected to the extract port 44 in the discharge chamber 41 through the inlet passage 45.

Figure 15:
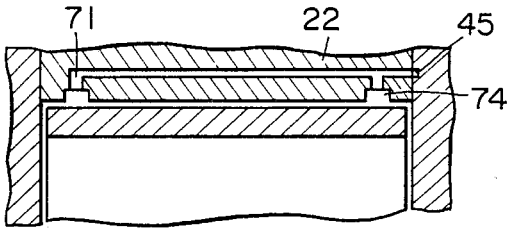
FIG. 15 is an axial section taken along the inlet port of the embodiment of FIG. 14.

Upon rotation of the rotary compressor as shown in FIGS. 14 to 16, high-pressure air enters and flows along the guide grooves 74 from the inlet port 71 therein to rapidly go round the contact zone and spread to the central portion of the inner periphery of the center housing, thereby increasing the bearing effect uniformly in the full axial length of the contact zone. The rotary sleeve 30 is fluidly supported and axially balanced, so that it is protected against direct contact with the contact zone even if pushed from within toward the contact zone by compressed air.

Figure 17:
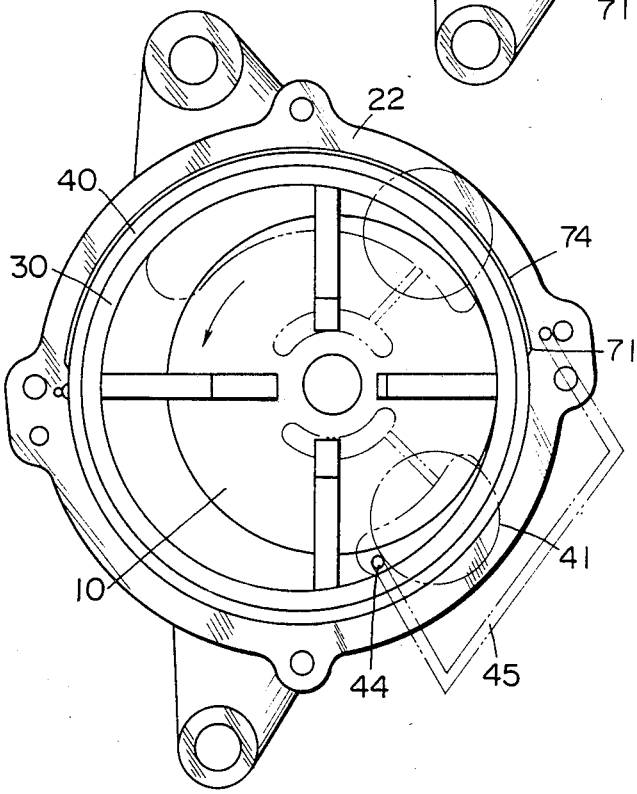

The embodiment of FIG. 17 has the guide grooves 74 provided in the suction side opposite to the contact zone. The guide groove has its inlet port 71 connected to the extract port 44 of the discharge chamber 41 through the inlet passage 45. In this embodiment, the high-pressure air increases the bearing effect in the suction side of the air-bearing room 40 to keep the axial balance of rotary sleeve and prevent the rotary sleeve 30 from contacting the suction side inner periphery of the center housing 22 even if a sudden change in the rotational speed of engine causes abnormal movement of the rotary sleeve.

Figure 18:
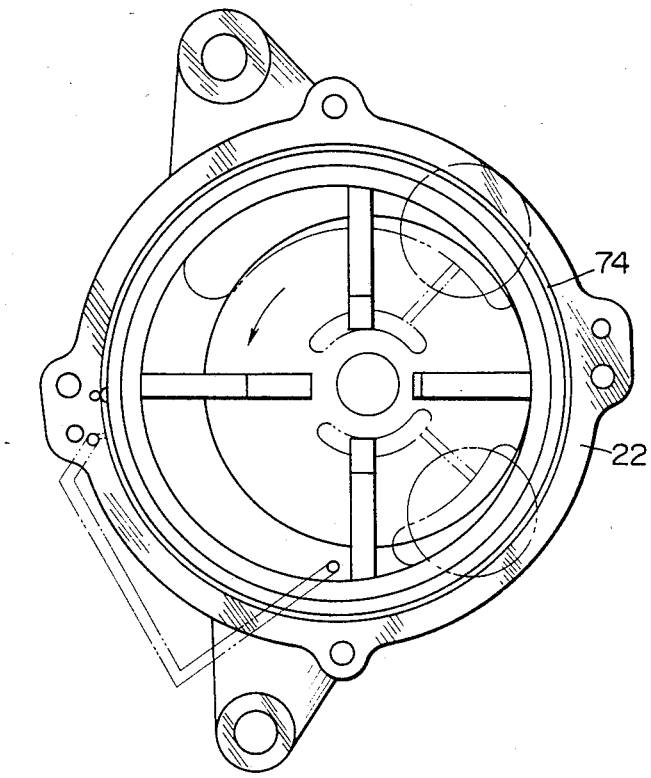

In the embodiment of FIG. 18, the guide grooves 74 are formed in the entire periphery of the center housing 22. This embodiment is similar both to those of FIGS. 14 and 16 in which the inlet port is provided in or in the vicinity of the contact zone and connected to the extract port 44 of the discharge chamber or working space 43 under the maximum pressure through the inlet passage 45 to increase the bearing effect in the compression side of the air-bearing room 40 and prevent the rotary sleeve 30 from contacting the compression side inner periphery of the center housing 22, and to that of FIG. 17 in which the guide grooves in the suction side increase the bearing effect in the suction side of the air-bearing room and prevent the rotary sleeve 30 from contacting the suction side inner periphery of the center housing 22. The guide grooves 74 can be formed in the opposite end portions of the rotary sleeve 30 as seen in FIG. 8 or the rotary sleeve 30 and the center housing 22 as seen in FIG. 9.

From the foregoing, the apparatus of the invention has a pair of guide grooves in the opposite ends of the air-bearing room to axially equalize a bearing effect of the air-bearing room and keep the axial balance of the rotary sleeve. The axial balance is particularly needed in the air-bearing room supplied with high-pressure air to increase the bearing effect. Without the guide groove of the invention, the rotary sleeve might be out of balance and marginally in contact with the inner periphery of the center housing by the high-pressure air. The inventive apparatus can remarkably reduce troubles that the rotary sleeve scuffs the inner periphery of the center housing and that the rotary sleeve makes an irregular rotation, because the rotary sleeve is well balanced and floatingly supported.

INDUSTRIAL APPLICABILITY

The rotary compressor, provided with the inventive apparatus for fluidly supporting a rotary sleeve which is rotatable with vanes, is suitably used as a supercharger for an internal combustion engine, especially for an automobile engine. The reason for this is that frictional heat as well as wear is relatively small during rotation and that it has less scuffing troubles under high speed running or sudden speed change operations.

We claim:

1. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a working space defined by said two adjacent vanes through an inlet passage (45), characterized in that said center housing (22) have the opposite end portions thereof formed with peripherally extending guide grooves (74).

2. The apparatus of claim 1, wherein said guide grooves (74) are formed in a contact zone in the compression side inner periphery of said center housing (22).

3. The apparatus of claim 2, wherein said guide grooves (74) are formed between a position of said contact zone in which said air-bearing room (40) has the maximum pressure and the terminal line of said contact zone.

4. The apparatus of claim 1, wherein said guide grooves (74) are formed in the suction side inner periphery of said center housing (22).

5. The apparatus of claim 1, wherein said guide grooves (74) are formed in the entire inner periphery of said center housing (22).

6. The apparatus of claim 1, wherein said inlet port (71) is opened to said guide groove (74) and connected through said inlet passage (45) to said working space (43) immediately before a position in which said working space is connected to said discharge chamber (41).

7. The apparatus of claim 1, wherein said inlet port (71) is axially alined with the starting line of said contact zone in the inner periphery of said center housing (22) which said rotary sleeve (30) is likely to contact.

8. Apparatus for supporting rotary sleeve of rotary compressor by fluid, said apparatus comprising a center housing (22), a rotary sleeve (30) mounted in said center housing for rotation with a plurality of vanes (16) movably fitted in a rotary (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a discharge chamber through an inlet passage (45), characterized in that said center housing (22) have the opposite end portions thereof formed with peripherally extending guide grooves (74).

9. The apparatus of claim 8, wherein said guide grooves (74) are formed in a contact zone in the compression side inner periphery of said center housing (22).

10. The apparatus of claim 8, wherein said guide grooves (74) are formed in the suction side inner periphery of said center housing (22).

11. The apparatus of claim 8, wherein said guide grooves (74) are formed in the entire periphery of said center housing.

12. The apparatus of claim 8, wherein said inlet port (71) is opened to said guide groove (74) and connected through said inlet passage (45) to said discharge chamber (41).

13. The apparatus of claim 8, wherein said inlet port (71) is axially aligned with the starting line of said contact zone in the inner periphery of said center housing (22) which said rotary sleeve (30) is likely to contact.

14. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a discharge chamber and a working space defined by said two adjacent vanes through an inlet passage (45), characterized in that said center housing (22) have the opposite and portions there of formed with peripherally extending guide grooves (74).

15. Apparatus for supporting rotary sleeve or rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a working space defined by said two adjacent vanes through an inlet passage (45), characterized in that said rotary sleeve (30) have the opposite end portions thereof formed with peripherally extending guide grooves (74).

16. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a discharge chamber through an inlet passage (45), characterized in that said rotary sleeve (30) have the opposite end portions thereof formed with peripherally extending guide grooves (74).

17. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a discharge chamber and a working space defined by said two adjacent vanes through an inlet passage (45), characterized in that said rotary sleeve (30) have the opposite end portions thereof formed with peripherally extending guide grooves (74).

18. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a working space defined by said two adjacent vanes through an inlet passage (45), characterized in that said center housing (22) and said rotary sleeve (30) have the opposite end portions thereof formed with peripherally extending guide grooves (74).

19. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a discharge chamber through an inlet passage (45), characterized in that said center housing (22) and said rotary sleeve (30) have the opposite end portions thereof formed with peripherally extending guide grooves (74).

20. Apparatus for supporting rotary sleeve of rotary compressor by fluid, said apparatus comprising a center housing (22), a rotary sleeve (30) mounted in said center housing for rotation with a plurality of vanes (16) movably fitted in a rotor (10) which is eccentrically disposed in said rotary sleeve, an air-bearing room (40) defined between the outer periphery of said rotary sleeve and the inner periphery of said center housing, and an inlet port (71) provided in the inner periphery of said center housing and connected to a discharge chamber and a working space defined by said two adjacent vanes through an inlet passage (45), characterized in that said center housing (22) and said rotary sleeve (30) have the opposite end portions thereof formed with peripherally extending guide grooves (74).

* * * * *